US011219792B2

(12) United States Patent
Shou et al.

(10) Patent No.: US 11,219,792 B2
(45) Date of Patent: Jan. 11, 2022

(54) COMPOSITION, CONTAINER, SYSTEM AND METHODS

(71) Applicant: Optim Fire Essentials Pty Ltd, Taylors Hill (AU)

(72) Inventors: Guanjin Shou, Hangzhou (CN); Jiong Chen, Taylors Hill (AU)

(73) Assignee: Optim Fire Essentials Pty Ltd, Taylors Hill (AU)

( * ) Notice: Subject to any disclaimer, the term of this patent is extended or adjusted under 35 U.S.C. 154(b) by 147 days.

(21) Appl. No.: 16/313,457

(22) PCT Filed: Jul. 12, 2017

(86) PCT No.: PCT/CN2017/092633
§ 371 (c)(1),
(2) Date: Dec. 26, 2018

(87) PCT Pub. No.: WO2018/010663
PCT Pub. Date: Jan. 18, 2018

(65) Prior Publication Data

US 2019/0314661 A1 Oct. 17, 2019

(30) Foreign Application Priority Data

Jul. 12, 2016 (WO) ..... PCT/CN2016/089724

(51) Int. Cl.
*A62D 1/06* (2006.01)
*A62C 5/00* (2006.01)
(Continued)

(52) U.S. Cl.
CPC ..... *A62D 1/06* (2013.01); *A62C 5/002* (2013.01); *A62C 19/00* (2013.01); *A62D 1/0042* (2013.01)

(58) Field of Classification Search
CPC ..... A62D 1/06; A62D 1/0042
See application file for complete search history.

(56) References Cited

U.S. PATENT DOCUMENTS

2011/0308821 A1 12/2011 Katsuraku

FOREIGN PATENT DOCUMENTS

CN 102626547 A * 8/2012
CN 103007478 A 4/2013
(Continued)

OTHER PUBLICATIONS

English machine translation of Wang et al. CN 102626547 A (Year: 2012).*

(Continued)

*Primary Examiner* — Peter F Godenschwager
(74) *Attorney, Agent, or Firm* — Mintz Levin Cohn Ferris Glovsky and Popeo, P.C.; Ingrid A. Beattie; Michael A. Mattoni

(57) ABSTRACT

The fire-escape composition is composed of two components, one consisting essentially of urea, diammonium hydrogen phosphate, ammonium hydrogen carbonate, sodium bicarbonate, fluorocarbon surfactant and water; the other consisting of tartaric acid, potassium citrate and potassium dihydrogen phosphate, wherein the two components are combined before usage. The fire-escaping system comprises the fire-escape composition and a container with a chamber, wherein the container is to be applied to a fire so as to deliver the composition.

8 Claims, 7 Drawing Sheets

(51) Int. Cl.
*A62C 19/00* (2006.01)
*A62D 1/00* (2006.01)

(56) References Cited

FOREIGN PATENT DOCUMENTS

| | | | |
|---|---|---|---|
| CN | 104606838 | A | 5/2015 |
| JP | 2001037901 | A | 2/2001 |
| WO | 2011162768 | A1 | 12/2011 |

OTHER PUBLICATIONS

International Search Report and Written Opinion issued in International Patent Application No. PCT/CN2017/092633 dated Sep. 27, 2017.

* cited by examiner

EXAMPLE 1 – BLENDING INSTRUCTIONS

EXAMPLE 2 – BLENDING INSTRUCTIONS

EXAMPLE 3 – BLENDING INSTRUCTIONS

EXAMPLE 4 – BLENDING INSTRUCTIONS

COMPOSITION, CONTAINER, SYSTEM AND METHODS

CROSS-REFERENCE TO RELATED APPLICATIONS

This application is a United States national stage application filed, under 35 U.S.C. § 371, of International Patent Application No. PCT/CN2017/092633, filed Jul. 12, 2017. International Patent Application No. PCT/CN2017/092633 claims the benefit of International Patent Application No. PCT/CN2016/089724, filed Jul. 12, 2016. Each of these applications is hereby incorporated by reference in their entirety.

FIELD

The present invention generally relates to chemical compositions and delivery systems for combating both commercial and domestic fires. The invention also relates to purposely manufactured containers for the delivery of said compositions.

BACKGROUND

In 2015, 1,565 occurrences of residential fires had resulted in at least AUD$30 million property damage in Melbourne (Australia) alone. Of these residential fires, 45% occurred in the kitchen, 9% in the bedroom, 5% in the lounge room, and 4% in the laundry room. The top causes of fire are commonly linked to cooking, smoking, heating equipment and arson.

Several measures can be put in place to mitigate such damage, as well as reduce loss of human lives. For example, a fire escape plan should form part of the requirements in commercial buildings, which are also commonly fitted with fire-extinguishing equipment, automatic sprinklers and smoke detectors. This compliance is clearly stated in Occupational Health and Safety Act (2004, Victoria, Australia) as well as in Compliance Code for Workspace Amenities and Work Environment (2008, Victoria, Australia).

Comparatively, residential housing, while more prone to fire hazards, is less protected. In some cases, a grease fire may result from a spill over a skillet onto a stove. Smoking in the bedroom may result in fire. An out-of-control fire may prevent the exit from homes or apartment buildings. In other cases, a person's clothes may also catch fire. Safety depends on the quickest way to put out the fire or the fastest way to get out of the premise. Such lapse in safety can be in part due the lack of fire planning and fire-fighting equipment, high cost of fixed fire fighting installations and the lack of maintenance of in-placed systems.

Accordingly, a fire-escape device for use in domestic and commercial buildings would be advantageous. Such a device could be used to create a means of egress from a burning room, house or building, by either dealing directly with the fire source or containing the fire along the escape route such that any person can exit the premise. Given its purposed function, the fire-escape device has to be multi-purpose (to fight different classes of fire), portable and light, contain non-toxic and non-corrosive components, have long shelf life, easy to replace and dispose, and require no special training or equipment to use.

Some of the known fire extinguishing compositions are rated according to the different types of fires for which they can be used. Each of the compositions generally requires specific apparatus for delivery due to the fact that the compositions may be in the form of foams, powders or liquids. Such systems are not versatile in fighting various classes of fire.

In addition, in such settings the delivery systems are generally quite heavy, and in a fire situation, are awkward to operate and maneuver.

Throw type fire extinguishers are also known. What is somewhat common is that many of the extinguishing systems utilise toxic and corrosive materials which may persist after extinguishing of the fire. For instance, selective fire retardants such as sodium silicate and alum which are used in some systems are quite corrosive and have been classified to be both external and internal irritants for humans and particularly cause tissue damage on mucus membranes. Other irritants which are also used in existing systems including ammonium dihydrogen phosphate and ammonium sulphate. These compounds can produce organ damage in relation to repeated and prolonged use and in some instances are classified as mutagenic in mammalian somatic cells.

JP 2001/037901 discloses the use of breakable containers for an extinguishing powder comprising urea, ammonium chloride, sodium carbon, sodium silicate, ammonium sulphate, alum and fluorocarbon surfactants. The material, once delivered to the fire source, provides an extinguishing effect through the generation of carbon dioxide and ammonium, which has a cooling effect on the fire. The containers disclosed in this document may break spontaneously if the temperature rises enough, may be thrown at a fire so that the composition covers the fire, or may be broken by hand into a bucket of water to provide an added fire extinguishing effect to the water. However, this system is heavy, contains toxic and corrosive materials, and may require additional steps to put out a fire.

In other prior art, a water composition containing fire extinguishing components is provided. Once delivered to the fire source, an extinguishing effect is achieved through the generation of carbon dioxide and ammonia via the thermal decomposition of the components. However, these systems also use toxic and corrosive materials such as ammonium sulphate. In addition, in the preparation the acid and base components are mixed together in hot water in the presence of catalyst (e.g. sodium chloride), which may result in the evolution of fire-extinguishing gases even before its application to the fire. This also suggests that the shelf-life of such fire extinguishers is limited.

The present invention seeks to overcome some of the shortcomings of the art in order to provide a light weight, easily operatable, fire-escaping device which is able to either extinguish a fire effectively or contain a fire, without the use of toxic and/or hazardous materials which may adversely affect the user.

SUMMARY OF INVENTION

In an aspect the invention provides a composition comprising:

(i) urea;
(ii) diammonium hydrogen phosphate;
(iii) ammonium hydrogen carbonate;
(iv) sodium bicarbonate;
(v) water; and
(vi) fluorocarbon surfactant.

The composition may optionally comprise further surfactant, such as 3-(N,N-dimethylmyristylammonio)propanesulfonate, or dodecyl trimethyl ammonium chloride, or dodecyl dimethyl betaine.

In another aspect, the invention provides a composition comprising:

i) urea;
ii) diammonium hydrogen phosphate;
iii) ammonium hydrogen carbonate;
iv) sodium bicarbonate;
v) ethylene glycol, or polyethylene glycol;
vi) water; and
vii) fluorocarbon surfactant.

The composition may optionally comprise further surfactant, such as 3-(N,N-dimethylmyristylammonio)propanesulfonate, or dodecyl trimethyl ammonium chloride, or dodecyl dimethyl betaine.

In another aspect the invention provides a composition comprising (% wt/wt based on the total composition):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) water about 40% to about 70%; and
(vi) fluorocarbon surfactant about 1% to about 4%.

The composition may optionally comprise further surfactant, such as 3-(N,N-dimethylmyristylammonio)propanesulfonate, or dodecyl trimethyl ammonium chloride, or dodecyl dimethyl betaine about 1% to about 4%.

In another aspect, the invention provides a composition comprising (% wt/wt based on the total composition):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) ethylene glycol about 1% to about 5% or polyethylene glycol about 1% to about 5%;
(vi) water about 40% to about 70%; and
(vii) fluorocarbon surfactant about 1% to about 4%.

The composition may optionally comprise further surfactant, such as 3-(N,N-dimethylmyristylammonio)propanesulfonate, or dodecyl trimethyl ammonium chloride, or dodecyl dimethyl betaine about 1% to about 4%.

In another aspect, the invention provides a composition comprising (% wt/wt based on the total composition):

(i) urea about 10%;
(ii) diammonium hydrogen phosphate about 20%;
(iii) ammonium hydrogen carbonate about 10%;
(iv) sodium bicarbonate about 4%;
(v) ethylene glycol about 3%;
(vi) water about 50%; and
(vii) fluorocarbon surfactant about 3%.

In another aspect the invention provides a two component composition wherein:

the first component comprises:

(i) urea;
(ii) diammonium hydrogen phosphate;
(iii) ammonium hydrogen carbonate;
(iv) sodium bicarbonate;
(v) water; and
(vi) fluorocarbon surfactant;
(vii) optionally 3-(N,N-dimethylmyristylammonio)propanesulfonate, or dodecyl trimethyl ammonium chloride, or dodecyl dimethyl betaine; and the second component comprises:

(i) tartaric acid;
(ii) potassium citrate; and
(iii) potassium dihydrogen phosphate, and wherein the first component and the second component are combined just prior to use.

In another aspect the invention provides a two component composition wherein:

the first component comprises:

(i) urea;
(ii) diammonium hydrogen phosphate;
(iii) ammonium hydrogen carbonate;
(iv) sodium bicarbonate;
(v) ethylene glycol, or polyethylene glycol;
(vi) water; and
(vii) fluorocarbon surfactant;
(viii) optionally 3-(N,N-dimethylmyristylammonio)propanesulfonate, or dodecyl trimethyl ammonium chloride, or dodecyl dimethyl betaine; and the second component comprises:

(i) tartaric acid;
(ii) potassium citrate; and
(iii) potassium dihydrogen phosphate, and wherein the first component and the second component are combined just prior to use.

In another aspect the invention provides a two component composition wherein:

the first component comprises (% wt/wt based on the total of the first component):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) water about 40% to about 70%; and
(vi) fluorocarbon surfactant about 1% to about 4%;
(vii) optionally 3-(N,N-dimethylmyristylammonio)propanesulfonate, or dodecyl trimethyl ammonium chloride, or dodecyl dimethyl betaine about 1% to about 4%; and the second component comprises (% wt/wt based on the total of the second component):

(i) tartaric acid about 97% to about 93%;
(ii) potassium citrate about 1% to about 5%; and
(iii) potassium dihydrogen phosphate about 1% to about 5%, and wherein the first component and the second component are combined just prior to use.

In another aspect the invention provides a two component composition wherein:

the first component comprises (% wt/wt based on the total of the first component):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) ethylene glycol about 1% to about 5%, or polyethylene glycol about 1% to about 5%;
(vi) water about 40% to about 70%; and
(vii) fluorocarbon surfactant about 1% to about 4%;
(viii) optionally 3-(N,N-dimethylmyristylammonio)propanesulfonate, or dodecyl trimethyl ammonium chloride, or dodecyl dimethyl betaine about 1% to about 4%; and the second component comprises (% wt/wt based on the total of the second component):

(i) tartaric acid about 97% to about 93%;

(ii) potassium citrate about 1% to about 5%; and (iii) potassium dihydrogen phosphate about 1% to about 5%, and wherein the first component and the second component are combined just prior to use.

In another aspect the invention provides a container for delivering the fire-escaping composition to a fire source, said container comprising a chamber housed within the container, the container and chamber being adapted to contain first and second components respectively, a first end portion of a sealing member receivable in the opening of the chamber so as to sealably separate the components and wherein the second end portion of the sealing member is pullable external to the container to withdraw the first end portion from the opening of the chamber thereby allowing the components to be combined.

In one embodiment, an end of the second end portion comprises a pull-ring.

In one embodiment, the container has a lid portion for sealing the container.

In one embodiment, the second end portion extends through an aperture in the lid portion so as to allow the sealing member to be pullable external to the container.

In one embodiment, the aperture comprises at least one O-ring which contacts the surface of the second end portion to form a seal.

In one embodiment, the lid portion further comprises a cap for protecting the second end portion of the sealing member.

In one embodiment, the outer circumference of the first end portion of the sealing member comprises at least one O-ring to seal the chamber. More preferably, the sealing member comprises two O-rings.

In another aspect the invention provides a fire-escaping system which comprises a composition and a container for said composition, the composition comprising:

(i) urea;

(ii) diammonium hydrogen phosphate;

(iii) ammonium hydrogen carbonate;

(iv) sodium bicarbonate;

(v) water;

(vi) fluorocarbon surfactant; and (vii) optionally 3-(N,N-dimethylmyristylammonio)propanesulfonate, or dodecyl trimethyl ammonium chloride, or dodecyl dimethyl betaine, wherein the container comprises a chamber housed within the container, the container adapted to contain the composition, a first end portion of a sealing member receivable in the opening of the chamber so as to sealably separate the composition from the chamber and wherein the second end portion of the sealing member is pullable external to the container to withdraw the first end portion of the sealing member from the opening of the chamber thereby allowing the composition to enter the chamber.

In another aspect the invention provides a fire-escaping system which comprises a composition and a container for said composition, the composition comprising:

(i) urea;

(ii) diammonium hydrogen phosphate;

(iii) ammonium hydrogen carbonate;

(iv) sodium bicarbonate;

(v) ethylene glycol, or polyethylene glycol;

(vi) water;

(vii) fluorocarbon surfactant; and (viii) optionally 3-(N,N-dimethylmyristylammonio)propanesulfonate, or dodecyl trimethyl ammonium chloride, or dodecyl dimethyl betaine, wherein the container comprises a chamber housed within the container, the container adapted to contain the composition, a first end portion of a sealing member receivable in the opening of the chamber so as to sealably separate the composition from the chamber and wherein the second end portion of the sealing member is pullable external to the container to withdraw the first end portion of the sealing member from the opening of the chamber thereby allowing the composition to enter the chamber.

In another aspect the invention provides a fire-escaping system which comprises a composition and a container for said composition, the composition comprising (% wt/wt based on the total of the composition):

(i) urea about 5% to about 20%;

(ii) diammonium hydrogen phosphate about 5% to about 25%;

(iii) ammonium hydrogen carbonate about 5% to about 15%;

(iv) sodium bicarbonate about 2% to about 6%;

(v) water about 40% to about 70%;

(vi) fluorocarbon surfactant about 1% to about 4%; and (vii) optionally 3-(N,N-dimethylmyristylammonio)propanesulfonate, or dodecyl trimethyl ammonium chloride, or dodecyl dimethyl betaine about 1% to about 4%, wherein the container comprises a chamber housed within the container, the container adapted to contain the composition, a first end portion of a sealing member receivable in the opening of the chamber so as to sealably separate the composition from the chamber and wherein the second end portion of the sealing member is pullable external to the container to withdraw the first end portion of the sealing member from the opening of the chamber thereby allowing the composition to enter the chamber.

In another aspect the invention provides a fire-escaping system which comprises a composition and a container for said composition, the composition comprising (% wt/wt based on the total of the composition):

(i) urea about 5% to about 20%;

(ii) diammonium hydrogen phosphate about 5% to about 25%;

(iii) ammonium hydrogen carbonate about 5% to about 15%;

(iv) sodium bicarbonate about 2% to about 6%;

(v) ethylene glycol about 1% to about 5%, or polyethylene glycol about 1% to about 5%;

(vi) water about 40% to about 70%;

(vii) fluorocarbon surfactant about 1% to about 4%; and (viii) optionally 3-(N,N-dimethylmyristylammonio)propanesulfonate, or dodecyl trimethyl ammonium chloride, or dodecyl dimethyl betaine about 1% to about 4%, wherein the container comprises a chamber housed within the container, the container adapted to contain the composition, a first end portion of a sealing member receivable in the opening of the chamber so as to sealably separate the composition from the chamber and wherein the second end portion of the sealing member is pullable external to the container to withdraw the first end portion of the sealing member from the opening of the chamber thereby allowing the composition to enter the chamber.

In another aspect the invention provides a fire-escaping system which comprises a composition and a container which contains said composition, the composition comprising:

(i) urea;
(ii) diammonium hydrogen phosphate;
(iii) ammonium hydrogen carbonate;
(iv) sodium bicarbonate;
(v) water;
(vi) fluorocarbon surfactant; and
(vii) optionally 3-(N,N-dimethylmyristylammonio)propanesulfonate, or dodecyl trimethyl ammonium chloride, or dodecyl dimethyl betaine, wherein the container is to be applied to a fire so as to deliver the composition.

In another aspect the invention provides a fire-escaping system which comprises a composition and a container which contains said composition, the composition comprising:

(i) urea;
(ii) diammonium hydrogen phosphate;
(iii) ammonium hydrogen carbonate;
(iv) sodium bicarbonate;
(v) ethylene glycol, or polyethylene glycol;
(vi) water;
(vii) fluorocarbon surfactant; and
(viii) optionally 3-(N,N-dimethylmyristylammonio)propanesulfonate, or dodecyl trimethyl ammonium chloride, or dodecyl dimethyl betaine, wherein the container is to be applied to a fire so as to deliver the composition.

In another aspect the invention provides a fire-escaping system which comprises a composition and a container which contains said composition, the composition comprising (% wt/wt based on the total of the composition):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) water about 40% to about 70%;
(vi) fluorocarbon surfactant about 1% to about 4%; and
(vii) optionally 3-(N,N-dimethylmyristylammonio)propanesulfonate, or dodecyl trimethyl ammonium chloride, or dodecyl dimethyl betaine about 1% to about 4%;

wherein the container is to be applied to a fire so as to deliver the composition.

In another aspect the invention provides a fire-escaping system which comprises a composition and a container which contains said composition, the composition comprising (% wt/wt based on the total of the composition):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) ethylene glycol about 1% to about 5%, or polyethylene glycol about 1% to about 5%;
(vi) water about 40% to about 70%;
(vii) fluorocarbon surfactant about 1% to about 4%; and
(viii) optionally 3-(N,N-dimethylmyristylammonio)propanesulfonate, or dodecyl trimethyl ammonium chloride, or dodecyl dimethyl betaine about 1% to about 4%;

wherein the container is to be applied to a fire so as to deliver the composition.

In another aspect the invention provides a fire-escaping system which comprises a composition and a container which contains said composition, the composition comprising (% wt/wt based on the total of the composition):

(i) urea about 10%;
(ii) diammonium hydrogen phosphate about 20%;
(iii) ammonium hydrogen carbonate about 10%;
(iv) sodium bicarbonate about 4%;
(v) ethylene glycol about 3%
(vi) water about 50%; and
(vii) fluorocarbon surfactant about 3%;

wherein the container is to be applied to a fire so as to deliver the composition.

In another aspect the invention provides a fire-escaping system which comprises first and second compositional components and a container for said components wherein, the first component comprises:

(i) urea;
(ii) diammonium hydrogen phosphate;
(iii) ammonium hydrogen carbonate;
(iv) sodium bicarbonate;
(v) water;
(vi) fluorocarbon surfactant; and
(vii) optionally 3-(N,N-dimethylmyristylammonio)propanesulfonate, or dodecyl trimethyl ammonium chloride, or dodecyl dimethyl betaine;

the second component comprises:

(i) tartaric acid;
(ii) potassium citrate; and
(iii) potassium dihydrogen phosphate, wherein said container comprising a chamber housed within the container, the container and chamber being adapted to contain first and second components respectively, a first end portion of a sealing member receivable in the opening of the chamber so as to sealably separate the components and wherein the second end portion of the sealing member is pullable external to the container to withdraw the first end portion from the opening of the chamber thereby allowing the components to be combined.

In another aspect the invention provides a fire-escaping system which comprises first and second compositional components and a container for said components wherein, the first component comprises:

(i) urea;
(ii) diammonium hydrogen phosphate;
(iii) ammonium hydrogen carbonate;
(iv) sodium bicarbonate;
(v) ethylene glycol, or polyethylene glycol;
(vi) water;
(vii) fluorocarbon surfactant; and
(viii) optionally 3-(N,N-dimethylmyristylammonio)propanesulfonate, or dodecyl trimethyl ammonium chloride, or dodecyl dimethyl betaine;

the second component comprises:

(i) tartaric acid;
(ii) potassium citrate; and
(iii) potassium dihydrogen phosphate, wherein said container comprising a chamber housed within the container, the container and chamber being adapted to contain first and second components respectively, a first end portion of a sealing member receivable in the opening of the chamber so as to sealably separate the components and wherein the second end portion of the sealing member is pullable external to the container to withdraw the first end portion from the opening of the chamber thereby allowing the components to be combined.

In another aspect the invention provides a fire-escaping system which comprises first and second compositional components and a container for said components, wherein the first component comprises (% wtlwt of the total of the first component):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) water about 40% to about 70%;
(vi) fluorocarbon surfactant about 1% to about 4%;
(vii) optionally 3-(N,N-dimethylmyristylammonio)propanesulfonate, or dodecyl trimethyl ammonium chloride, or dodecyl dimethyl betaine about 1% to about 4%;

the second component comprises (% wt/wt of the total of the second component):

(i) tartaric acid about 97% to about 93%;
(ii) potassium citrate about 1% to about 5%; and
(iii) potassium dihydrogen phosphate about 1% to about 5%, wherein said container comprising a chamber housed within the container, the container and chamber being adapted to contain first and second components respectively, a first end portion of a sealing member receivable in the opening of the chamber so as to sealably separate the components and wherein the second end portion of the sealing member is pullable external to the container to withdraw the first end portion from the opening of the chamber thereby allowing the components to be combined.

In another aspect the invention provides a fire-escaping system which comprises first and second compositional components and a container for said components, wherein the first component comprises (% wt/wt of the total of the first component):

(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) ethylene glycol about 1% to about 5%, or polyethylene glycol about 1% to about 5%;
(vi) water about 40% to about 70%;
(vii) fluorocarbon surfactant about 1% to about 4%; and
(viii) optionally 3-(N,N-dimethylmyristylammonio)propanesulfonate, or dodecyl trimethyl ammonium chloride, or dodecyl dimethyl betaine about 1% to about 4%;

the second component comprises (% wt/wt of the total of the second component):

(i) tartaric acid about 97% to about 93%;
(ii) potassium citrate about 1% to about 5%; and
(iii) potassium dihydrogen phosphate about 1% to about 5%, wherein said container comprising a chamber housed within the container, the container and chamber being adapted to contain first and second components respectively, a first end portion of a sealing member receivable in the opening of the chamber so as to sealably separate the components and wherein the second end portion of the sealing member is pullable external to the container to withdraw the first end portion from the opening of the chamber thereby allowing the components to be combined.

In relation to the invention providing a fire-escaping system which comprises first and second compositional components and a container for said components, the first component is contained within the container and the second component is contained within the chamber. In a further aspect the invention provides a low-temperature method for preparing a first component composition as mentioned above.

In embodiments and in relation to all aspects of the embodiment, the invention provides a fire-escaping composition or system which satisfies the Australian and New Zealand requirements for portable fire extinguishers, for example A/NZS 1841.

In embodiments and in relation to all aspects of the embodiment, the invention provides a fire-escaping composition or system which satisfies the Australian and New Zealand classification, rating and performance testing standard for portable fire extinguishers, for example A/NZS 1850.

DEFINITIONS

Figure 1:
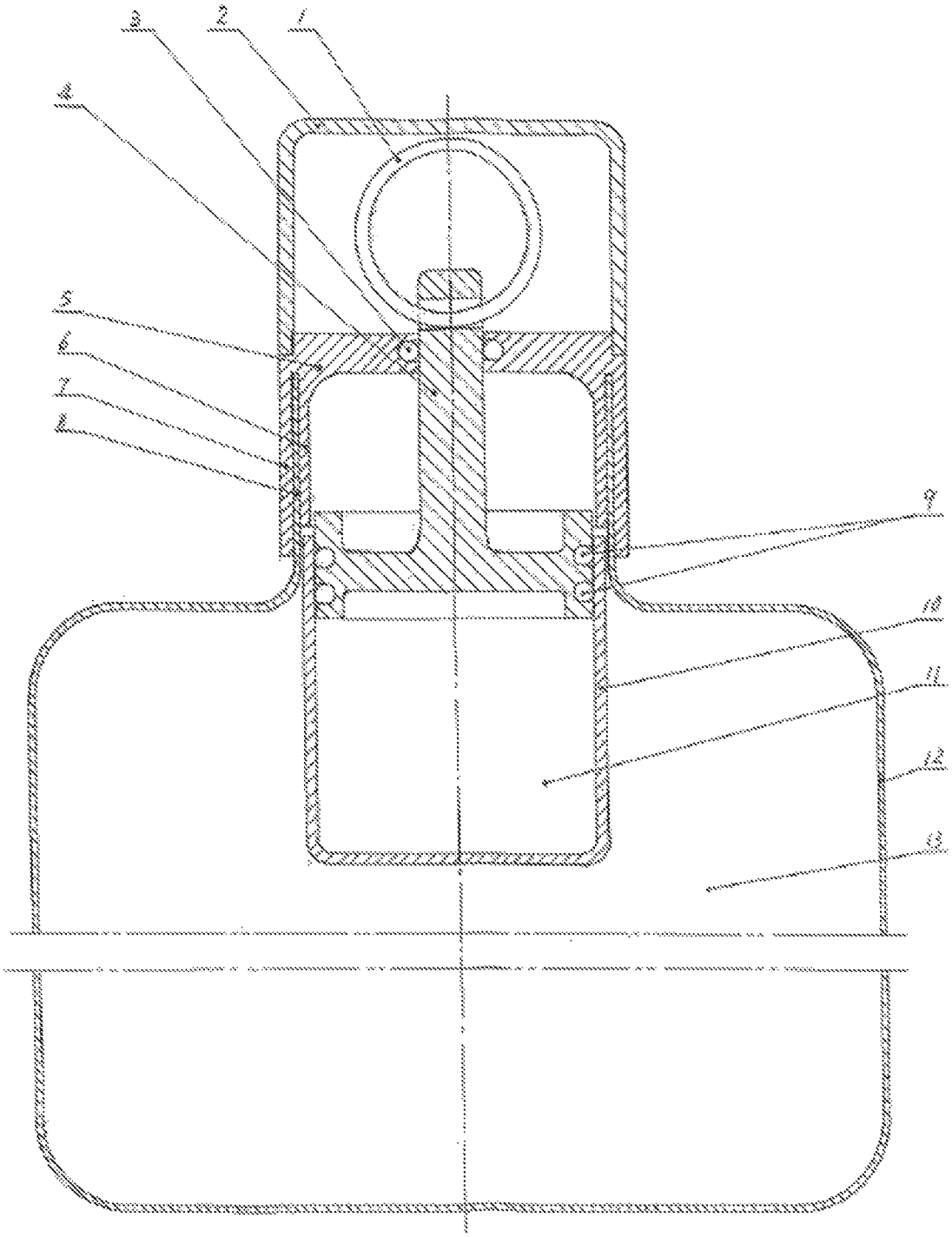
FIG. 1 depicts a cross-section of a container for delivering a fire-escaping composition according to an embodiment of the present invention.

As used herein the term "fire-escaping composition" refers to a chemical composition which when applied to a fire can be used to create a means of egress from a burning room, house or building, by either extinguishing the fire at its source or containing the fire along the escape path, such that the user can exit the premise.

As used herein the term "fire-escaping device" refers to a device which contains a chemical composition, and when applied to a fire can be used to create a means of egress from a burning room, house or building, by either extinguishing the fire at its source or containing the fire along the escape path, such that the user can exit the premise.

"Urea" refers to the organic compound with the claimed formula $CO(NH_2)_2$.

"Diammonium hydrogen phosphate" refers to a compound with the formula $(NH_2)_2HPO_4$ also known as diammonium phosphate or DAP.

"Ammonium hydrogen carbonate" refers to a compound with the formula $(NH_4)HCO_3$, also known as ammonium bicarbonate.

"Sodium bicarbonate" refers to a compound with the formula $NaHCO_3$ also known as sodium hydrogen carbonate, baking soda, and bicarbonate of soda.

"Polyethylene glycol" refers to a compound that his a polymer of ethylene oxide, with the formula of H—(O—$CH_2$—$CH_2$)$_n$—OH, also known as polyethylene oxide or polyoxyethylene. The molecular weight of polyethylene glycol can vary according to the number of repeats of the monomer.

"Ethylene glycol" refers to a compound of the formula $C_2H_6O_2$, also known as ethane-1,2-diol and 1,2-dihydroxyethane.

"Surfactant" refers to a substance which tends to reduce the surface tension of a liquid in which it is dissolved. In the present invention, surfactant can act as film forming and foaming additives, which provide better flow and spread over the fire source to aid fire suppression and prevent re-ignition. A surfactant may be a fluorocarbon surfactant or a non-fluorocarbon surfactant.

"Fluorocarbon surfactant" refers to a fluorocarbon surfactant which is a liquid at around 30° C. These can be poly or perfluorinated. Examples include perfluorooctanesulfonic acid (PFOS), perfluorooctanoic acid (PFOA), perfluorononanoic acid (PFNA) and perfluorobutanesulfonic acid (PFBA). The surfactant may be a composition comprising of fluorocarbon surfactant and hydrocarbon co-surfactants (anionic and amphoteric in about 1:4 ratio) among other ingredients. An example is DuPont Capstone 1440.

"3-(N,N-dimethylmyristylammonio)propanesulfonate" refers to a compound of the formula $CH_3(CH_2)_{13}N^+(CH_3)_2CH_2CH_2CH_2SO_{3-}$ also known as myristyl sulfobetaine, 3-(Myristyldimethylammonio)propanesulfonate, or N-tetradecyl-N,N-dimethyl-3-ammonio-1-propanesulfonate. This compound is a zwitterionic surfactant with a CMC of 0.1-0.4 mM (at 20-25° C.).

"Dodecyl trimethyl ammonium chloride" refers to a compound of the formula $CH_3(CH_2)_{11}N^+(CH_3)_3Cl^-$ also referred to as DTAC. This compound is a zwitterionic surfactant.

"Dodeyl dimethyl betaine" refers to a compound of the formula $CH_3(CH2)_{11}N^+(CH_3)_3CH_2COO^-$, also known as lauryl betaine. This compound is a zwitterionic surfactant with a CMC of 1.6-2.1 mM (at 20-25° C.).

Figure 2:
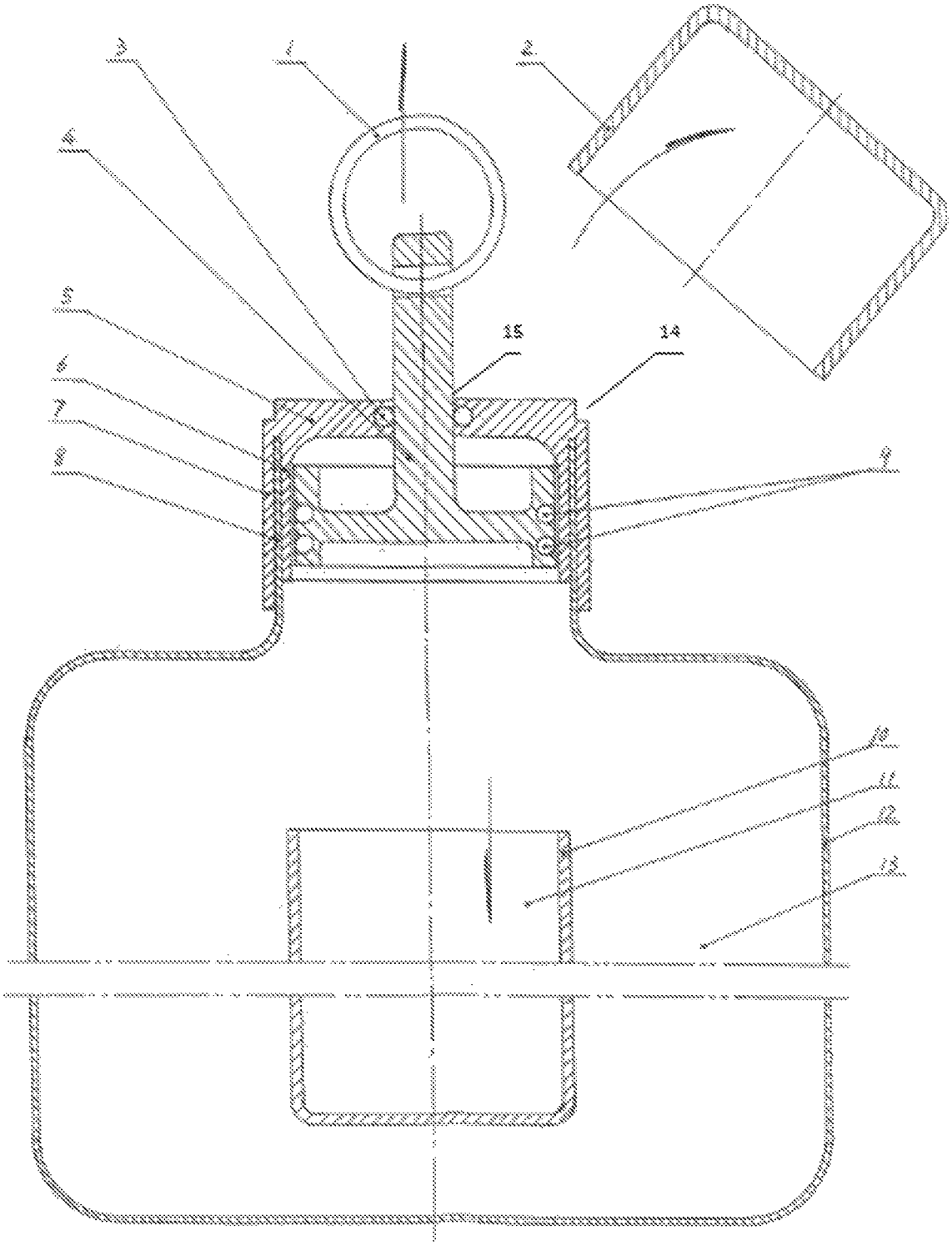
FIG. 2 depicts a cross-section of a container (with the cap removed) for delivery of a fire-escaping composition according to an embodiment of the present invention.

In FIGS. 1 and 2, there is shown cross-sectional views of a container for delivering a fire-extinguishing composition which is formed of a container 12 having a lid portion 5, a chamber 10, a sealing member 4 and a cap 2. The container 12 is adapted to hold a first component 13 while the chamber 10 is adapted to hold a second component 11. A first end portion of the sealing member 4 is received in the opening of the chamber 10 while the second end portion of the sealing member 4 forms a shaft which attaches the chamber 10 to the lid portion 5 within the container 12. In this way, the chamber 10 is suspended within the container 12. A pair of O-rings 9 provided on the outer circumference of the sealing member 4 come in contact with the inner circumference of the opening 8 of the chamber 10 to form a seal and to restrict movement of the sealing member 4 without undue force. Therefore, the second component 11 is sealed within the chamber 10 and allows separation of the components 11, 13.

The sealing member 4 can be manipulated, for example, pulled, such that the sealing member 4 is detached from the opening of the chamber 10 so that the chamber 10 drops into the container 12 and allows the two components 11, 13 to come into contact, as shown in FIG. 2. The container 12 for delivering a fire-extinguishing composition can then be thrown into a fire source. The combination of the two components 11, 13 results in a highly expansive composition or foam which acts to retard the fire.

Figure 3:
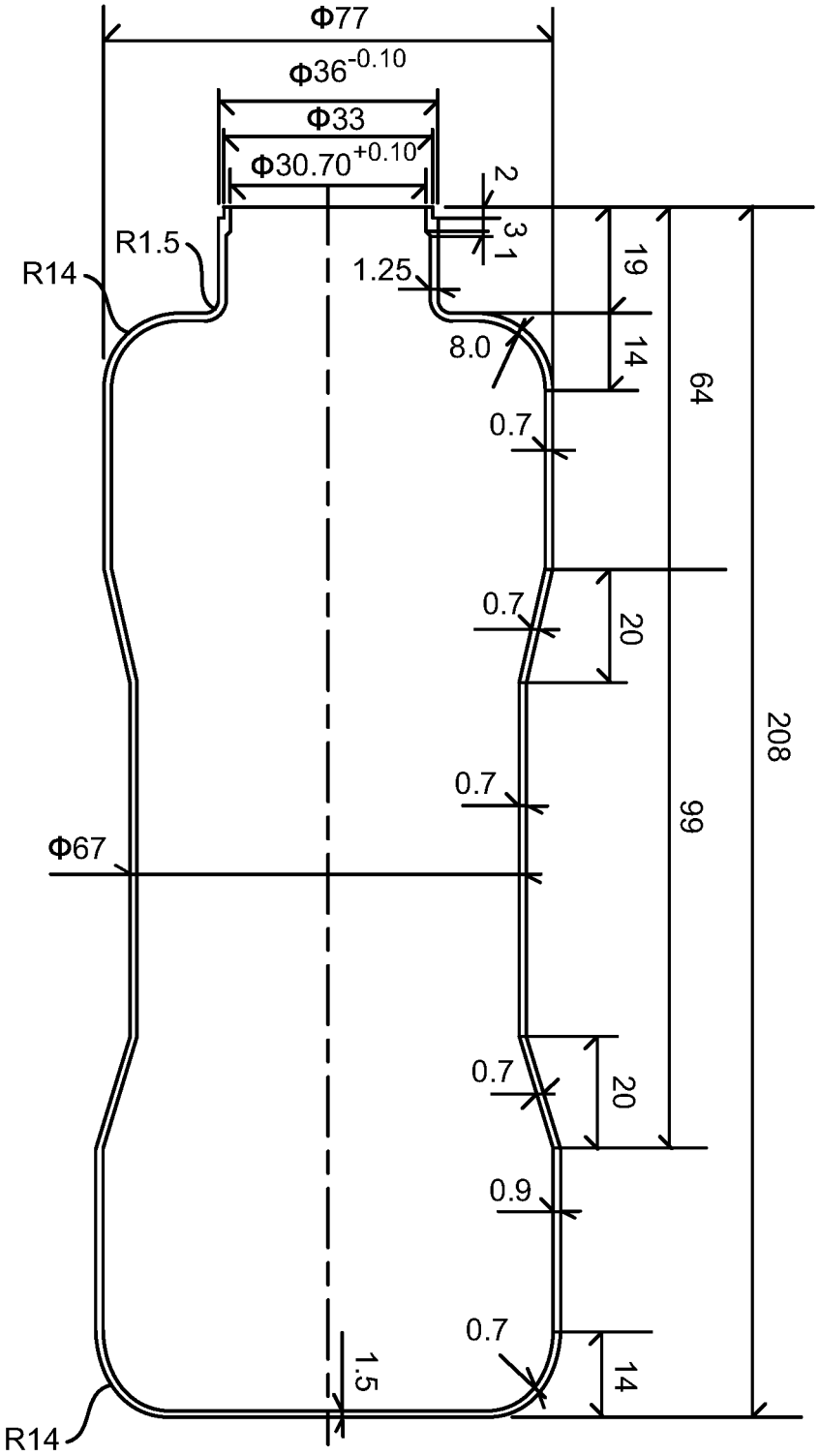
FIG. 3 depicts a cross-section of a container for delivery of a fire-escaping composition according to an embodiment of the present invention.
Figure 4:
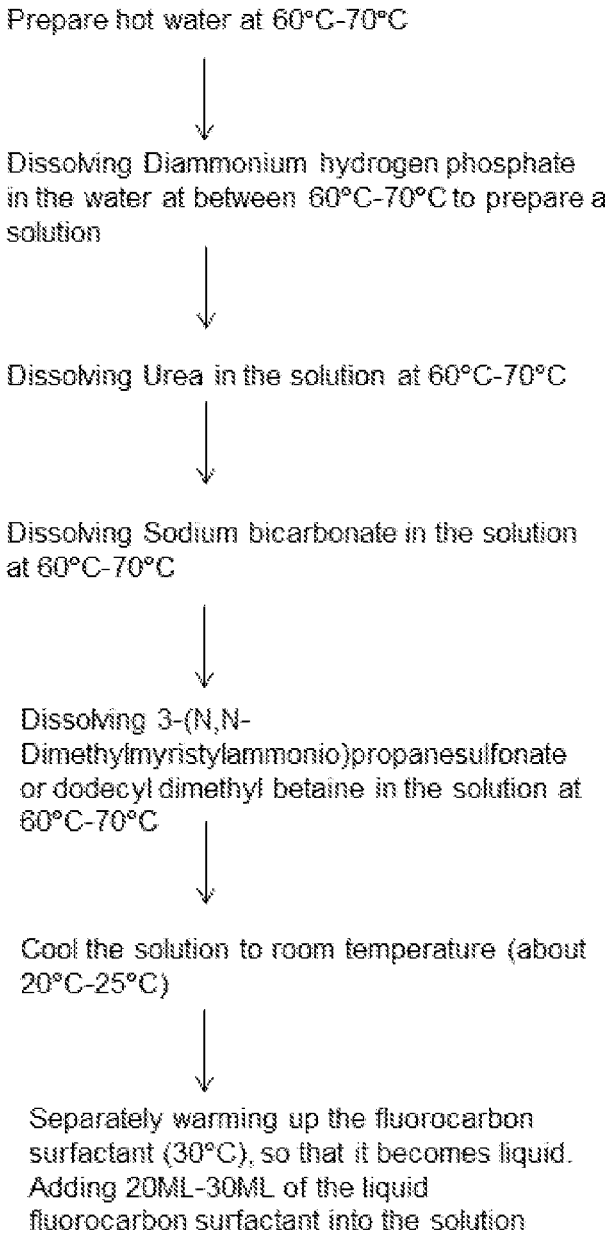
FIG. 4 depicts a flow diagram of blending instructions in a first example.
Figure 5:
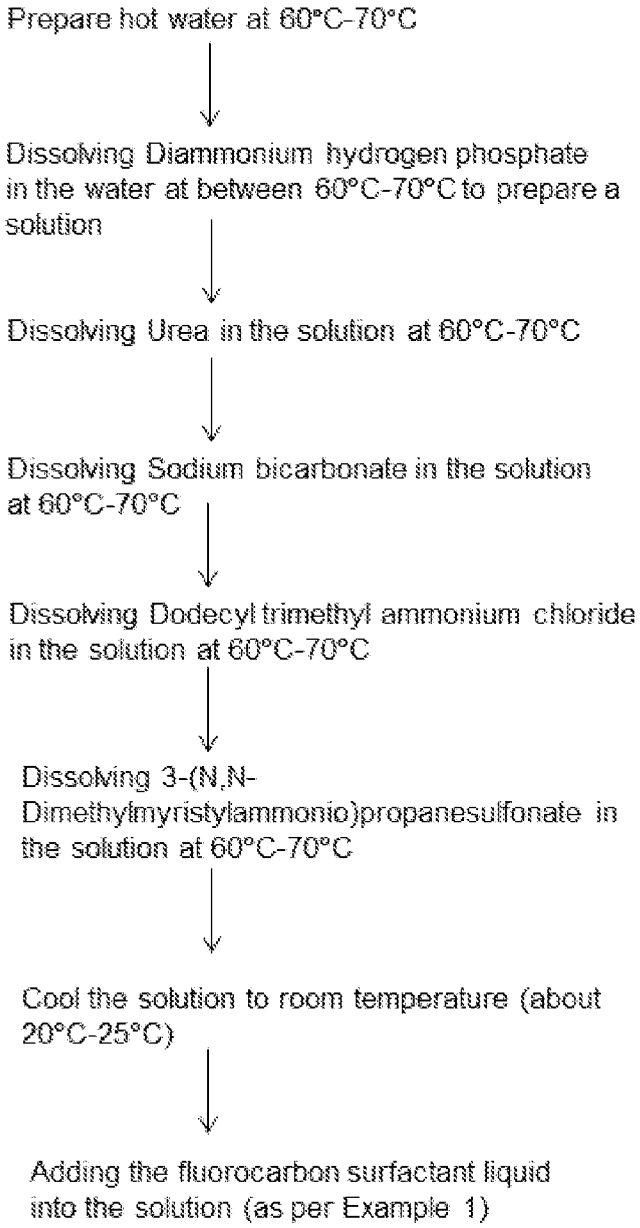
FIG. 5 depicts a flow diagram of blending instructions in a second example.
Figure 6:
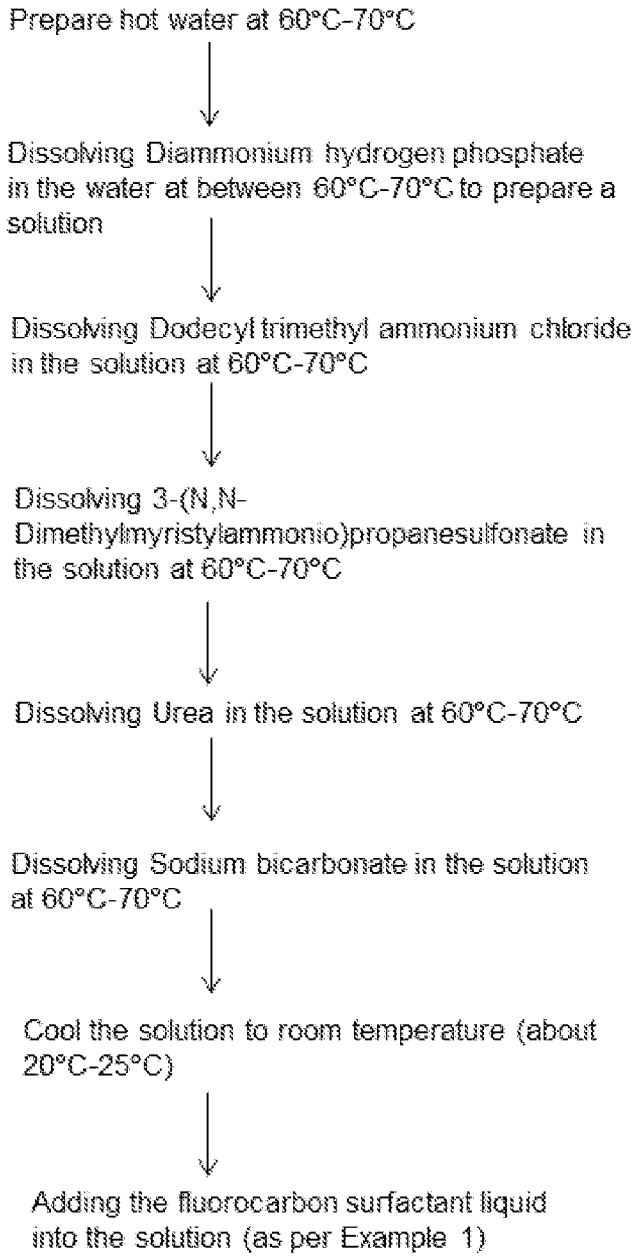
FIG. 6 depicts a flow diagram of blending instructions in a third example.
Figure 7:
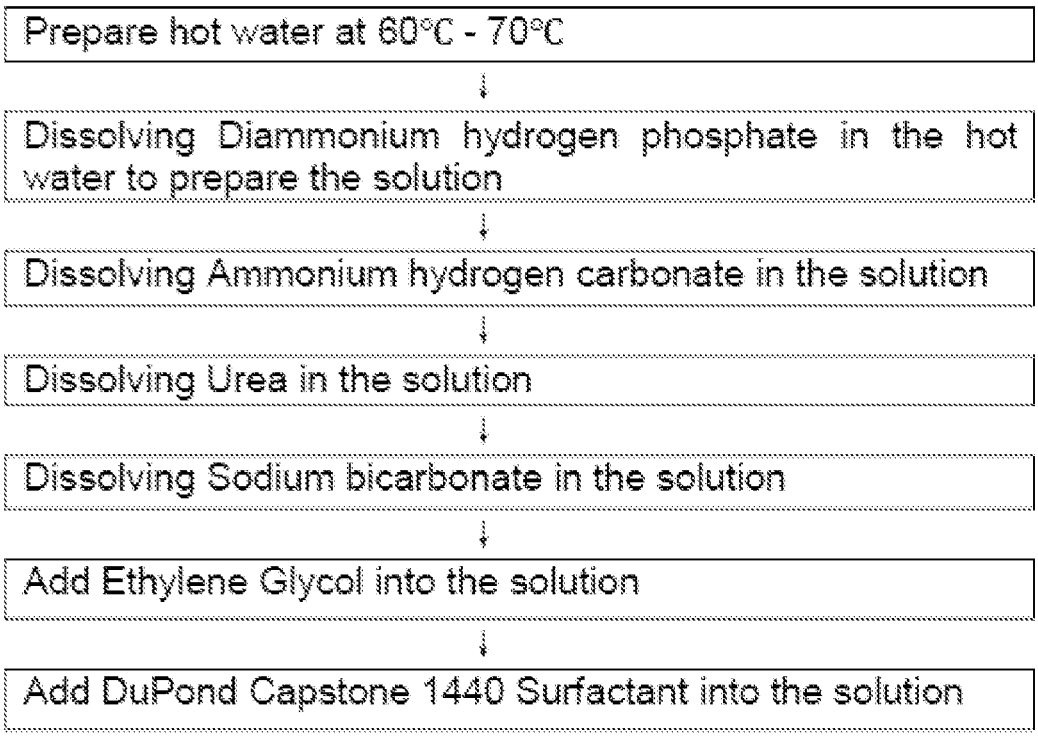
FIG. 7 depicts a flow diagram of blending instructions in a fourth example.

A further advantage of the system is that the foaming creates a high pressure differentiated within the container so that the container is able to self-destruct once it is dispatched into the fire vicinity and comes into contact with a surface. In this way the fire extinguishing contents can be dispersed in and around the fire by contact even with a soft surface such as a cushioned surface (i.e., like a bed, mattress, carpet, sofa and the like). It will be appreciated that a container which doesn't contain the two component system (such as that depicted in FIG. 3) can still function when dispatched and contacted with a hard surface, such as wood, concrete or steel.

The bottom end of the lid portion 5 has two coaxial and parallel portions 6, 7 which form a groove there between, into which the opening 8 of the container 12 can be fitted. In this way, the lid portion 5, sealing member 4, chamber 10 and container 12 provide sealed environments where the first and second components 11, 13, are separately contained.

The second end portion of the sealing member 4 forming the shaft extends through an aperture 15 formed in the top end of the lid portion 5 and is adapted to allow slidable movement of the shaft 4 within the aperture. The aperture also comprises a groove, into which an O-ring 3 can be provided. The O-ring 3 makes contact with the surface of the shaft 4 so as to form a seal, yet provides sufficient friction to allow slidable movement of the shaft 4 within the aperture 15 when the shaft 4 is manipulated. The end of the shaft 4 can be provided with a ring 1 for easy manual manipulation.

At the top outer circumference of the lid portion 5, there is also provided a groove 14 into which an opening of a cap 2 can be fitted to cover the top end of the lid portion 5. The cap 2 therefore also protects the end of the shaft 4 to prevent accidental movement of the sealing member 4, which may result in an accidental discharge of the container 12.

As shown in FIG. 2, the outer circumference of the sealing member 4 is less that the inner circumference of the lid portion 5. In this way, the sealing member 4 can be withdrawn into the interior of the lid portion 5. At the same time, the opening of the chamber 11 abuts the lower end of the inner coaxial parallel portion 6 of the lid portion 5. Therefore, as the sealing member 4 is withdrawn into the lid portion 5, the sealing member 4 is pulled away from the opening of the chamber 10 by the ends of the inner coaxial parallel portion 6, unsealing and detaching from the chamber 10. The chamber 10 then is free to drop into the bottom of the container 12 and allows the second component 11 to combine with any contents, such as the first component 13, within the container 12.

As an example of a use of the container for delivering a fire-escaping composition, when a fire source has been identified, the cap 2 can be removed from the top of the lid portion 5, as shown in FIG. 2. A user grips the ring 1 and pulls it before throwing the container 12 in the vicinity of the fire source. The act of pulling the ring 1 causes the sealing member 4 to withdraw into the lid portion 5 and chamber 10 is pushed away from the sealing member 4 thereby unsealing it. The second component 11 which has been sealingly contained in the chamber 10 can then combine with the first component 13. The two components can then mix to produce a highly expansive fire-retardant foam or composition which eliminates or reduces the fire.

In an embodiment, the composition comprises urea. In another embodiment, the composition comprises between about 5 and about 20% (% wt/wt) urea. In another embodiment, the composition comprises about 5% (% wt/wt) urea. In another embodiment, the composition comprises about 10% (% wt/wt) urea. In another embodiment, the composition comprises about 15% (% wt/wt) urea. In another embodiment, the composition comprises about 20% (% wt/wt) urea.

In an embodiment, the first component of the composition comprises urea. In another embodiment, the first component of the composition comprises between about 5 and about 20% (% wt/wt) urea. In another embodiment, the first component of the composition comprises about 5% (% wt/wt) urea. In another embodiment, the first component of the composition comprises about 10% (% wt/wt) urea. In another embodiment, the first component of the composition comprises about 15% (% wt/wt) urea. In another embodiment, the first component of the composition comprises about 20% (% wt/wt) urea.

In an embodiment, the composition comprises diammonium hydrogen phosphate. In another embodiment, the composition comprises between about 5 and about 25% (% wt/wt) diammonium hydrogen phosphate. In another embodiment, the composition comprises about 5% (% wt/wt) diammonium hydrogen phosphate. In another embodiment, the composition comprises about 10% (% wt/wt) diammonium hydrogen phosphate. In another embodiment, the composition comprises about 15% (% wt/wt) diammonium hydrogen phosphate. In another embodiment, the composition comprises about 20% (% wt/wt) diammonium hydrogen phosphate. In another embodiment, the composition comprises about 25% (% wt/wt) diammonium hydrogen phosphate.

In an embodiment, the first component of the composition comprises diammonium hydrogen phosphate. In another embodiment, the first component of the composition comprises between about 5 and about 25% (% wt/wt) diammonium hydrogen phosphate. In another embodiment, the first component of the composition comprises about 5% (% wt/wt) diammonium hydrogen phosphate. In another embodiment, the first component of the composition comprises about 10% (% wt/wt) diammonium hydrogen phosphate. In another embodiment, the first component of the composition comprises about 15% (% wt/wt) diammonium hydrogen phosphate. In another embodiment, the first component of the composition comprises about 20% (% wt/wt) diammonium hydrogen phosphate. In another embodiment, the first component of the composition comprises about 25% (% wt/wt) diammonium hydrogen phosphate.

In an embodiment, the composition comprises ammonium hydrogen carbonate. In another embodiment, the composition comprises between about 5 and about 15% (% wt/wt) ammonium hydrogen carbonate. In another embodiment, the composition comprises about 5% (% wt/wt) ammonium hydrogen carbonate. In another embodiment, the composition comprises about 7% (% wt/wt) ammonium hydrogen carbonate. In another embodiment, the composition comprises about 9% (% wt/wt) ammonium hydrogen carbonate. In another embodiment, the composition comprises about 10% (% wt/wt) ammonium hydrogen carbonate. In another embodiment, the composition comprises about 11% (% wt/wt) ammonium hydrogen carbonate. In another embodiment, the composition comprises about 13% (% wt/wt) ammonium hydrogen carbonate. In another embodiment, the composition comprises about 15% (% wt/wt) ammonium hydrogen carbonate.

In an embodiment, the first component of the composition comprises ammonium hydrogen carbonate. In another embodiment, the first component of the composition comprises between about 5 and about 15% (% wt/wt) ammonium hydrogen carbonate. In another embodiment, the first component of the composition comprises about 5% (% wt/wt) ammonium hydrogen carbonate. In another embodiment, the first component of the composition comprises about 7% (% wt/wt) ammonium hydrogen carbonate. In another embodiment, the first component of the composition comprises about 9% (% wt/wt) ammonium hydrogen carbonate. In another embodiment, the composition comprises about 10% (% wt/wt) ammonium hydrogen carbonate. In another embodiment, the first component of the composition comprises about 11% (% wt/wt) ammonium hydrogen carbonate. In another embodiment, the first component of the composition comprises about 13% (% wt/wt) ammonium hydrogen carbonate. In another embodiment, the first component of the composition comprises about 15% (% wt/wt) ammonium hydrogen carbonate.

In an embodiment, the composition comprises sodium bicarbonate. In another embodiment, the composition comprises between about 2 and about 6% (% wt/wt) sodium bicarbonate. In another embodiment, the composition comprises about 2% (% wt/wt) sodium bicarbonate. In another embodiment, the composition comprises about 3% (% wt/wt) sodium bicarbonate. In another embodiment, the composition comprises about 4% (% wt/wt) sodium bicarbonate. In another embodiment, the composition comprises about 5% (% wt/wt) sodium bicarbonate. In another embodiment, the composition comprises about 6% (% wt/wt) sodium bicarbonate.

In an embodiment, the first component of the composition comprises sodium bicarbonate. In another embodiment, the first component of the composition comprises between about 2 and about 6% (% wt/wt) sodium bicarbonate. In another embodiment, the first component of the composition comprises about 2% (% wt/wt) sodium bicarbonate. In another embodiment, the first component of the composition comprises about 3% (% wt/wt) sodium bicarbonate. In another embodiment, the first component of the composition comprises about 4% (% wt/wt) sodium bicarbonate. In another embodiment, the first component of the composition comprises about 5% (% wt/wt) sodium bicarbonate. In another embodiment, the first component of the composition comprises about 6% (% wt/wt) sodium bicarbonate.

In an embodiment, the composition comprises a glycol, for instance, polyethylene glycol or ethylene glycol. In one embodiment, the glycol is PEG 200. In another embodiment, the glycol is PEG 400. In another embodiment, the glycol is PEG 600. In another embodiment, the glycol is PEG 800. In another embodiment, the glycol is ethylene glycol. The glycol can act as a solvent. Preferably, the composition comprises about 1% to about 5% (% wt/wt) glycol.

In an embodiment, the composition comprises a polyethylene glycol. The polyethylene glycol can act as a solvent. In another embodiment, the composition comprises about 1% to about 5% (% wt/wt) polyethylene glycol. In another embodiment, the composition comprises about 1% (% wt/wt) polyethylene glycol. In another embodiment, the composition comprises about 2% (% wt/wt) polyethylene glycol. In another embodiment, the composition comprises about 3% (% wt/wt) polyethylene glycol. In another embodiment, the composition comprises about 4% (% wt/wt) polyethylene glycol. In another embodiment, the composition comprises about 5% (% wt/wt) polyethylene glycol.

In an embodiment, the first component comprises polyethylene glycol. The polyethylene glycol can act as a solvent. In another embodiment, the first component comprises about 1% to about 5% (% wt/wt) polyethylene glycol. In another embodiment, the first component comprises about 1% (% wt/wt) polyethylene glycol. In another embodiment, the first component comprises about 2% (% wt/wt) polyethylene glycol. In another embodiment, the first component comprises about 3% (% wt/wt) polyethylene glycol. In another embodiment, the first component comprises about 4% (% wt/wt) polyethylene glycol. In another embodiment, the first component comprises about 5% (% wt/wt) polyethylene glycol.

In an embodiment, the composition comprises ethylene glycol. The ethylene glycol can act as a solvent. In another embodiment, the composition comprises about 1% to about 5% (% wt/wt) ethylene glycol. In another embodiment, the composition comprises about 1% (% wt/wt) ethylene glycol. In another embodiment, the composition comprises about 2% (% wt/wt) ethylene glycol. In another embodiment, the composition comprises about 3% (% wt/wt) ethylene glycol. In another embodiment, the composition comprises about 4% (% wt/wt) ethylene glycol. In another embodiment, the composition comprises about 5% (% wt/wt) ethylene glycol.

In an embodiment, the first component comprises ethylene glycol. The ethylene glycol can act as a solvent. In another embodiment, the first component comprises about 1% to about 5% (% wt/wt) ethylene glycol. In another embodiment, the first component comprises about 1% (% wt/wt) ethylene glycol. In another embodiment, the first component comprises about 2% (% wt/wt) ethylene glycol. In another embodiment, the first component comprises about 3% (% wt/wt) ethylene glycol. In another embodiment, the first component comprises about 4% (% wt/wt) ethylene glycol. In another embodiment, the first component comprises about 5% (% wt/wt) ethylene glycol.

In an embodiment, the composition comprises water. In another embodiment, the composition comprises between about 40 and about 70% (% wt/wt) water. In another embodiment, the composition comprises about 40% (% wt/wt) water. In another embodiment, the composition comprises about 50% (% wt/wt) water. In another embodiment, the composition comprises about 60% (% wt/wt) water. In another embodiment, the composition comprises about 70% (% wt/wt) water.

In an embodiment, the first component of the composition comprises water. In another embodiment, the first component of the composition comprises between about 40 and about 70% (% wt/wt) water. In another embodiment, the first component of the composition comprises about 40% (% wt/wt) water. In another embodiment, the first component of the composition comprises about 50% (% wt/wt) water. In another embodiment, the first component of the composition comprises about 60% (% wt/wt) water. In another embodiment, the first component of the composition comprises about 70% (% wt/wt) water.

In an embodiment, the composition comprises a fluorocarbon surfactant. In another embodiment, the composition comprises between about 1 and about 4% (% wt/wt) of a fluorocarbon surfactant. In another embodiment, the composition comprises about 1% (% wt/wt) of a fluorocarbon surfactant. In an embodiment, the composition comprises about 2% (% wt/wt) of a fluorocarbon surfactant. In an embodiment, the composition comprises about 3% (% wt/wt) of a fluorocarbon surfactant. In an embodiment, the composition comprises about 4% (% wt/wt) of a fluorocarbon surfactant.

In an embodiment, the first component of the composition comprises a fluorocarbon surfactant. In another embodiment, the first component of the composition comprises between about 1 and about 4% (% wt/wt) of a fluorocarbon surfactant. In an embodiment, the first component of the composition comprises about 1% (% wt/wt) of a fluorocarbon surfactant. In an embodiment, the first component of the composition comprises about 2% (% wt/wt) of a fluorocarbon surfactant. In an embodiment, the first component of the composition comprises about 3% (% wt/wt) of a fluorocarbon surfactant. In an embodiment, the first component of the composition comprises about 4% (% wt/wt) of a fluorocarbon surfactant.

In an embodiment, the composition may optionally comprises 3-(N,N-dimethylmyristylammonio)propanesulfonate. In another embodiment, the composition comprises between about 1 and about 4% (% wt/wt) 3-(N,N-dimethylmyristylammonio)propanesulfonate. In another embodiment, the composition comprises about 1% (% wt/wt) 3-(N,N-dimethylmyristylammonio)propanesulfonate. In another embodiment, the composition comprises about 2% (% wt/wt) 3-(N,N-dimethylmyristylammonio)propanesulfonate. In another embodiment, the composition comprises about 3% (% wt/wt) 3-(N,N-dimethylmyristylammonio)propanesulfonate. In another embodiment, the composition comprises about 4% (% wt/wt) 3-(N,N-dimethylmyristylammonio)propanesulfonate.

In an embodiment, the composition may optionally comprises dodecyl trimethyl ammonium chloride. In another embodiment, the composition comprises between about 1 and about 4% (% wt/wt) dodecyl trimethyl ammonium chloride. In another embodiment, the composition comprises about 1% (% wt/wt) dodecyl trimethyl ammonium chloride. In another embodiment, the composition comprises about 2% (% wt/wt) dodecyl trimethyl ammonium chloride. In another embodiment, the composition comprises about 3% (% wt/wt) dodecyl trimethyl ammonium chloride. In another embodiment, the composition comprises about 4% (% wt/wt) dodecyl trimethyl ammonium chloride.

In an embodiment, the composition may optionally comprises dodecyl dimethyl betaine. In another embodiment, the composition comprises between about 1 and about 4% (% wt/wt) dodecyl dimethyl betaine. In another embodiment, the composition comprises about 1% (% wt/wt) dodecyl dimethyl betaine. In another embodiment, the composition comprises about 2% (% wt/wt) dodecyl dimethyl betaine. In another embodiment, the composition comprises about 3% (% wt/wt) dodecyl dimethyl betaine. In another embodiment, the composition comprises about 4% (% wt/wt) dodecyl dimethyl betaine.

In an embodiment, the first component of the composition may optionally comprises 3-(N,N-dimethylmyristylammonio)propanesulfonate. In another embodiment, the first component of the composition comprises between about 1 and about 4% (% wt/wt) 3-(N,N-dimethylmyristylammonio)propanesulfonate. In another embodiment, the first component of the composition comprises about 1% (% wt/wt) 3-(N,N-dimethylmyristylammonio)propanesulfonate. In another embodiment, the first component of the composition comprises about 2% (% wt/wt) 3-(N,N-dimethylmyristylammonio)propanesulfonate. In another embodiment, the first component of the composition comprises about 3% (% wt/wt) 3-(N,N-dimethylmyristylammonio)propanesulfonate. In another embodiment, the first component of the composition comprises about 4% (% wt/wt) 3-(N,N-dimethylmyristylammonio)propanesulfonate.

In an embodiment, the first component of the composition may optionally comprises dodecyl trimethyl ammonium chloride. In another embodiment, the first component of the composition comprises between about 1 and about 4% (% wt/wt) dodecyl trimethyl ammonium chloride. In another embodiment, the first component of the composition comprises about 1% (% wt/wt) dodecyl trimethyl ammonium chloride. In another embodiment, the first component of the composition comprises about 2% (% wt/wt) dodecyl trimethyl ammonium chloride. In another embodiment, the first component of the composition comprises about 3% (% wt/wt) dodecyl trimethyl ammonium chloride. In another embodiment, the first component of the composition comprises about 4% (% wt/wt) dodecyl trimethyl ammonium chloride.

In an embodiment, the first component of the composition may optionally comprises dodecyl dimethyl betaine. In another embodiment, the first component of the composition comprises between about 1 and about 4% (% wt/wt) dodecyl dimethyl betaine. In another embodiment, the first component of the composition comprises about 1% (% wt/wt) dodecyl dimethyl betaine. In another embodiment, the first component of the composition comprises about 2% (% wt/wt) dodecyl dimethyl betaine. In another embodiment, the first component of the composition comprises about 3% (% wt/wt) dodecyl dimethyl betaine. In another embodiment, the first component of the composition comprises about 4% (% wt/wt) dodecyl dimethyl betaine.

In an embodiment, the second component of the composition comprises tartaric acid. In another embodiment, the composition of the second component comprises between about 93 and about 97% (% wt/wt) tartaric acid. In another embodiment, the composition of the second component comprises about 93% (% wt/wt) tartaric acid. In another embodiment, the composition of the second component comprises about 94% (% wt/wt) tartaric acid. In another embodiment, the composition of the second component comprises about 95% (% wt/wt) tartaric acid. In another embodiment, the composition of the second component comprises about 96% (% wt/wt) tartaric acid. In another embodiment, the composition of the second component comprises about 97% (% wt/wt) tartaric acid.

In an embodiment, the second component of the composition comprises potassium citrate. In another embodiment, the composition of the second component comprises between about 1 and about 5% (% wt/wt) potassium citrate. In another embodiment, the composition of the second component comprises about 1% (% wt/wt) potassium citrate. In another embodiment, the composition of the second component comprises about 2% (% wt/wt) potassium citrate. In another embodiment, the composition of the second component comprises about 3% (% wt/wt) potassium citrate. In another embodiment, the composition of the second component comprises about 4% (% wt/wt) potassium citrate. In another embodiment, the composition of the second component comprises about 5% (% wt/wt) potassium citrate.

In an embodiment, the second component of the composition comprises potassium dihydrogen phosphate. In another embodiment, the composition of the second component comprises between about 1 and about 5% (% wt/wt) potassium dihydrogen phosphate. In another embodiment, the composition of the second component comprises about 1% (% wt/wt) potassium dihydrogen phosphate. In another embodiment, the composition of the second component comprises about 2% (% wt/wt) potassium dihydrogen phosphate. In another embodiment, the composition of the second component comprises about 3% (% wt/wt) potassium dihydrogen phosphate. In another embodiment, the composition of the second component comprises about 4% (% wt/wt) potassium dihydrogen phosphate. In another embodiment, the composition of the second component comprises about 5% (% wt/wt) potassium dihydrogen phosphate.

In another embodiment, the invention provides a composition comprising (% wt/wt based on the total composition):

(i) urea about 10%;
(ii) diammonium hydrogen phosphate about 20%;
(iii) ammonium hydrogen carbonate about 10%;
(iv) sodium bicarbonate about 4%;
(v) ethylene glycol about 3%;
(vi) water about 50%; and
(vii) DuPond Capstone 1440 Surfactant about 3%.

In another embodiment, the invention provides a fire-escaping system which comprises a composition and a container which contains said composition, the composition comprising (% wt/wt based on the total of the composition):

(i) urea about 10%;
(ii) diammonium hydrogen phosphate about 20%;
(iii) ammonium hydrogen carbonate about 10%;
(iv) sodium bicarbonate about 4%;
(v) ethylene glycol about 3%
(vi) water about 50%; and
(vii) DuPond Capstone 1440 Surfactant about 3%;

wherein the container is to be applied to a fire so as to deliver the composition.

The compositions of the present invention can be prepared by standard techniques, including blending in water. The present inventors have found that the stability of the components is better maintained at temperatures at 70° C. or below throughout the blending process. In one embodiment, the composition is prepared at a temperature of about 70° C. In another embodiment, the composition is prepared at a temperature of about 60° C. In another embodiment, the composition is prepared at a temperature of about 60 to 70° C. In another embodiment, the components of the composition are dissolved sequentially at about 70° C. In one embodiment, the composition is cooled before the fluorocarbon surfactant is added. In another embodiment, the composition is cooled to about 25° C. before the fluorocarbon surfactant is added. In another embodiment, the composition is cooled to about 20° C. before the fluorocarbon surfactant is added. In another embodiment, the composition is cooled to about 20 to 25° C. before the fluorocarbon surfactant is added.

One of the advantages of the present invention is that the compositions do not have toxic and corrosive components. As such, in some embodiments the compositions of the present invention do not allow for the addition of, for instance, sodium silicate, ammonium sulphate, alum and sodium chloride, which are essential elements in some known fire-extinguishing compositions.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

Throughout this specification and the claims which follow, unless the context requires otherwise, the phrase "consisting essentially of", and variations such as "consists essentially of" will be understood to indicate that the recited element(s) is/are essential i.e. necessary elements of the invention. The phrase allows for the presence of other non-recited elements which do not materially affect the characteristics of the invention but excludes additional unspecified elements which would affect the basic and novel characteristics of the method defined.

Based on the blending instructions of FIGS. 4-7, a composition based on the below mentioned percentages can be prepared:

| | |
|---|---|
| Water (H2O) | 50% |
| Urea (CH4N2O) | 10% |
| Diammonium hydrogen phosphate (NH4)2HPO4 | 20% |
| Ammonium hydrogen carbonate ($NH_4HCO_3$) | 10% |
| Sodium bicarbonate NaHCO3 | 4% |
| Ethylene Glycol | 3% |
| DuPond Capstone 1440 Surfactant | 3% |

The invention claimed is:

1. A composition comprising (% wt/wt based on the total composition):
(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) water about 40% to about 70%; and
(vi) fluorocarbon surfactant about 1% to about 4%.

2. A composition according to claim 1 comprising:
(i) urea;
(ii) diammonium hydrogen phosphate;
(iii) ammonium hydrogen carbonate;
(iv) sodium bicarbonate;
(v) ethylene glycol, or polyethylene glycol;
(vi) water; and
(vii) fluorocarbon surfactant.

3. A composition comprising (% wt/wt based on the total composition):
(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) ethylene glycol about 1% to about 5%, or polyethylene glycol about 1% to about 5%;
(vi) water about 40% to about 70%; and
(vii) fluorocarbon surfactant about 1% to about 4%.

4. A composition comprising (% wt/wt based on the total composition):
(i) urea about 10%;
(ii) diammonium hydrogen phosphate about 20%;
(iii) ammonium hydrogen carbonate about 10%;
(iv) sodium bicarbonate about 4%;
(v) ethylene glycol about 3%;
(vi) water about 50%; and
(vii) fluorocarbon surfactant about 3%.

5. A two component fire-escape composition wherein:
the first component comprises:
(i) urea;
(ii) diammonium hydrogen phosphate;
(iii) ammonium hydrogen carbonate;
(iv) sodium bicarbonate;
(v) water; and
(vi) fluorocarbon surfactant; and
the second component comprises:
(i) tartaric acid;
(ii) potassium citrate; and
(iii) potassium dihydrogen phosphate,
and wherein the first component and the second component are combined just prior to use.

6. A two component fire-escape composition according to claim 5 wherein:
the first component comprises:
(i) urea;
(ii) diammonium hydrogen phosphate;
(iii) ammonium hydrogen carbonate;
(iv) sodium bicarbonate;
(v) ethylene glycol, or polyethylene glycol;
(vi) water;
(vii) fluorocarbon surfactant; and
the second component comprises:
(i) tartaric acid;
(ii) potassium citrate; and
(iii) potassium dihydrogen phosphate,
and wherein the first component and the second component are combined just prior to use.

7. A two component fire-escape composition according to claim 5 wherein:
the first component comprises (% wt/wt based on the total of the first component):
(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) water about 40% to about 70%; and
(vi) fluorocarbon surfactant about 1% to about 4%; and
the second component comprises (% wt/wt based on the total of the second component):
(vii) tartaric acid about 97% to about 93%;
(viii) potassium citrate about 1% to about 5%; and
(ix) potassium dihydrogen phosphate about 1% to about 5%, and
wherein the first component and the second component are combined just prior to use.

8. A two component fire-escape composition according to claim 5 wherein:
the first component comprises (% wt/wt based on the total of the first component):
(i) urea about 5% to about 20%;
(ii) diammonium hydrogen phosphate about 5% to about 25%;
(iii) ammonium hydrogen carbonate about 5% to about 15%;
(iv) sodium bicarbonate about 2% to about 6%;
(v) ethylene glycol about 1% to about 5%, or polyethylene glycol about 1% to about 5%;
(vi) water about 40% to about 70%; and
(vii) fluorocarbon surfactant about 1% to about 4%; and
the second component comprises (% wt/wt based on the total of the second component):
(i) tartaric acid about 97% to about 93%;
(ii) potassium citrate about 1% to about 5%; and
(iii) potassium dihydrogen phosphate about 1% to about 5%, and
wherein the first component and the second component are combined just prior to use.

* * * * *